US006874346B1

(12) United States Patent
Faymonville

(10) Patent No.: US 6,874,346 B1
(45) Date of Patent: Apr. 5, 2005

(54) MULTI-FORM DIE BASE WITH ROTATABLE ANVILS HAVING ALTERNATIVE FORMING SURFACES

(76) Inventor: Phillip C. Faymonville, 12723 S. Maple Ave., Blue Island, IL (US) 60406

( * ) Notice: Subject to any disclaimer, the term of this patent is extended or adjusted under 35 U.S.C. 154(b) by 0 days.

(21) Appl. No.: 10/805,516

(22) Filed: Mar. 22, 2004

(51) Int. Cl.[7] ..... B21D 5/02; B21D 37/02
(52) U.S. Cl. ..... 72/389.4; 72/413; 72/481.1
(58) Field of Search ..... 72/389.4, 389.5, 72/389.6, 446, 413, 481.1, 414

(56) References Cited

U.S. PATENT DOCUMENTS 3,975,721 A * 8/1976 Franz ..... 340/251
4,403,495 A * 9/1983 Talbot ..... 72/383
4,774,994 A * 10/1988 Darter et al. ..... 164/341
4,918,971 A * 4/1990 Makino ..... 72/389.4
4,967,585 A * 11/1990 Grimaldo ..... 72/389.4
5,116,450 A * 5/1992 Spoo et al. ..... 156/441
5,249,452 A * 10/1993 Baldwin et al. ..... 72/389.4
5,253,502 A * 10/1993 Poletti ..... 72/213
5,305,659 A * 4/1994 Dieperink et al. ..... 72/389.4
6,178,799 B1 * 1/2001 Miller et al. ..... 72/315

* cited by examiner

*Primary Examiner*—David Jones
(74) *Attorney, Agent, or Firm*—Davis Chin

(57) ABSTRACT

An improved apparatus used in press brakes having a lower press member and an upper press member which are movable relative toward and away from each other for bending and forming sheet materials is provided. The apparatus includes a die base, first and second mobile carrier shoes, a plurality of spacer bars, and a pair of anvils. Each one of the pair of anvils is formed with four corners each having a separate and distinct radius of curvature so as to define four alternative forming surfaces. Each one of the anvils are selectively rotatable so that one of the four corners having the same radius of curvatures are on top and facing inwardly toward the other corresponding to first through fourth ones of the four alternative forming surfaces and forming first through fourth die-size openings therebetween used for bending and forming a material of different predetermined gauges. As a result, multiple bending operations with different gauges of sheet material can be achieved without changing completely to a different lower die.

18 Claims, 5 Drawing Sheets

MULTI-FORM DIE BASE WITH ROTATABLE ANVILS HAVING ALTERNATIVE FORMING SURFACES

BACKGROUND OF THE INVENTION

1. Field of the Invention

This invention relates generally to an apparatus and method for bending and forming sheet material such as sheet metal, plate steel and the like. More particularly, the present invention relates to a method and apparatus for enhancing the capability of the lower dies used in press brakes in which performance of multiple forming operations with different gauges of sheet material can be achieved without the need of changing to completely different lower dies. Specifically, the apparatus for bending and forming sheet material of the instant invention includes a die base, mobile carrier shoes, a plurality of spacer bars, and a pair of rotatable anvils having alternative forming surfaces.

2. Description of the Prior Art

As is generally well-known, press brakes are equipped with a lower press member and an upper press member which are movable relative toward and away from each other. Typically, the lower press member is stationary and the upper press member is reciprocatingly movable toward and away from the lower press member. The upper press member includes commonly a male forming tool (upper die or punch) having a bottom workpiece-deforming surface. The lower press member includes commonly an appropriately shaped lower die having an upper surface vertically aligned with the workpiece-deforming surface of the upper die. When the upper and lower dies are moved toward each other with a workpiece to be formed held over the lower die, the upper die descends into the workpiece and presses it into the lower die so as to deform the workpiece to a desired bent shape. However, it should be understood that the upper press member could be stationary and the lower press member is movable.

It is also generally known that the specific size and shape of the openings used in the lower dies are dependent upon the gauge of the material to be formed as well as the desired shape to be formed. For example, in many cases, the opening in the lower die is similar to the shape of the desired finished bend in the formed material. These openings in the lower dies must have the correct distance across the forming points (contact-forming surfaces) and have a sufficient depth therein so as to allow the required penetration of the material being formed into the lower dies and down to the point for achieving the desired angle of bend in the material.

Further, the side surfaces and the bottom surface of the lower dies must have sufficient strength for withstanding the pressure transferred from the material being formed so as to prevent their flexing and/or splitting. The upper two points (inside edges) of the lower die are the only points of contact or forming surfaces since the material being formed never actually engages with the bottommost area of the lower die. This type of bending operation is sometimes referred to as an "air" bend or "air forming" method. The finished shape of the material is determined by the actual shape of the upper die (punch) and the depth of penetration of the material being formed into the lower die, as the material will then spring back to its finished shape.

One of the major problems encountered heretofore with the prior art press brake dies arises from the fact that it is often necessary to interchange upper and lower dies having different radius of curvatures and different distances therebetween in order to be able to bend and form the material into a desired configuration. While the upper die (punch) may be used for several bending operations for different gauges of materials, this is generally not the case with respect to the lower die having a single-forming capability. Specifically, each gauge or shape of material being formed requires in many cases a separate and different appropriately-sized lower die to be substituted. Since these lower dies are manufactured conventionally from hard tool steel or similar material, they are generally quite large and heavy and are expensive to machine. Thus, these large and heavy lower dies must be unbolted and removed from the lower press member and new lower dies must be installed into the lower press member and then re-bolted. This operation is a considerable hindrance to the metal-forming industry in general since it causes a significant amount of downtime and expensive labor cost in exchanging of the lower dies to and from the press brakes due to their size and weight.

Another associated problem is that these lower dies require storage space for the ones not currently being used so that they can be re-used for future bending operations. This has resulted in a large number of different lower dies being stored for long periods of time at relatively high cost. In addition, there is suffered the disadvantages of having the unnecessary expense in the number of lower dies required to be purchased and of potential business opportunities being lost due to the unavailability of the appropriate lower die.

Accordingly, there exists a need for solving the above-mentioned problems of the prior art press brake dies. It therefore would be desirable to provide a method and apparatus for enhancing the capability of the lower dies in which performance of multiple forming operations with different gauges of sheet material can be achieved without the need of changing to completely different lower dies. It would also be expedient that the apparatus used in press brakes include a multi-form die base with rotatable anvils having alternative forming surfaces. The anvils are significantly smaller and lighter than the conventional lower dies and thus can be removed and installed in substantially less time.

A prior art search directed to the subject matter of this application in the U.S. Patent and Trademark Office revealed the following Letters Patent and application:

U.S. Pat. No. 3,975,721

U.S. Pat. No. 4,403,495

U.S. Pat. No. 4,774,994

U.S. Pat. No. 4,967,585

U.S. Pat. No. 5,116,450

U.S. Pat. No. 5,253,502

U.S. Pat. No. 6,178,799

In addition to the above issued prior art patents, there were also found published patent application No. 2001/0009106 to Gerritsen on published on Jul. 26, 2001 and published application No. 2003/0033846 to Runk et al. published on Feb. 20, 2003.

In U.S. Pat. No. 6,178,799 to Miller et al. issued on Jan. 30, 2001, there is disclosed a forming press for shaping angle-section workpieces which includes an upper die shoe and a lower die shoe. The upper die shoe has affixed to it a pair of guides and a forming die secured therebetween by sliding the forming die between the guides so that the keys ride in the keyways. The lower die shoe includes a pair of cam blocks and a pair of main body members disposed movably between the cam blocks. The horizontal portions of the main body members support a pair of spacers. Further, the lower die shoe includes a pair of forming die inserts secured to the spacers by keys riding in the keyways.

In U.S. Pat. No. 5,116,450 to Spoo et al. issued on May 26, 1992, there is taught a single die in which includes a mold base section and a mold insert section. The mold insert section is received in a channel portion so as to be removably connected to the mold base section by means of bolts and threaded holes. The die further includes a mold base section and a mold insert section which is received in a channel portion so as to be removably connected to the mold base section by means of bolts and threaded holes. A pair of clamp plates is provided for clamping the die therebetween. The mold insert sections can be disconnected from their corresponding mold base sections by removing the bolts. Then, new mold insert sections defining a different shaped or sized mold cavity can be connected to the respective mold base sections.

In U.S. Pat. No. 4,967,585 to Grimaldo issued on Nov. 6, 1990, there is taught a bending die and ram assembly for use in a tube bending machine which includes a bending die having a convexly curved die face for bending engagement with a metal tube supported by a pair of backshoe dies mounted on an outwardly pivoting pair of back gates. The ram assembly utilizes retractor hooks which cooperate with lugs projecting from the underside of the bending die to permit the die to be attached and detached from the ram assembly in a drop-in, lift-out manner without tools. As a result, multiple bending dies of different sizes can be interchanged without requiring tools to the front of the pusher block.

In U.S. Pat. No. 3,965,721 to Roch issued on Jun. 29, 1976, there is disclosed a die holder frame which is received in a die bed of a press brake. A die holder bar is mounted to the frame and is supported on a plurality of adjustable wedges. The forming die is mounted in the die holder bar. The wedges are individually adjustable to provide a crown along the length of the die holder bar and are adjustable as a group to provide various desired heights of the die bar holder.

The remaining patents, listed above but not specifically discussed, are deemed to be only of general interest and show the state of the art in forming press apparatuses for bending and forming of metal workpieces utilizing a first forming die and a second forming die being movable toward and away from the first forming die.

None of the prior art discussed above disclosed an apparatus for bending and forming sheet material like that of the present invention which includes a die base, mobile carrier shoes, a plurality of spacer bars, and a pair of rotatable anvils having alternative forming surfaces.

SUMMARY OF THE INVENTION

Accordingly, it is a general object of the present invention to provide an improved apparatus and method for bending and forming sheet material for use in a press brake which overcomes all of the problems encountered in the prior art.

It is an object of the present invention to a method and apparatus for enhancing the capability of the lower dies in which performance of multiple forming operations with different gauges of sheet material can be achieved without the need of changing to completely different lower dies.

It is another object of the present invention to provide an improved apparatus and method used in press brakes which includes a multi-form die base with rotatable anvils having alternative forming surfaces.

It is still another object of the present invention to provide an improved apparatus used in press brakes which includes a die base, mobile carrier shoes, a plurality of spacer bars, and a pair of rotatable anvils having alternative forming surfaces.

In a preferred embodiment of the present invention, there is provided an apparatus used in press brakes having a lower press member and an upper press member which are movable relative toward and away from each other for bending and forming sheet materials. The lower press member includes a die base formed of a generally U-shaped configuration and having a first recess and a second recess disposed opposite to the first recess. First and second mobile carrier shoes are disposed in a corresponding one of the opposed first and second recesses. A plurality of first and second movable spacer bars is also disposed in a corresponding one of the opposed first and second recesses. A pair of anvils is disposed in a corresponding one of the first and second mobile carrier shoes.

Each one of said pair of anvils is formed of a rectangular shape and has four corners each provided with a separate and distinct radius of curvature so as to define four alternative forming surfaces. Each one of the anvils is initially positioned so that a first one of the four corners having the same radius of curvature are on top and facing inwardly toward the other corresponding to a first one of the four alternative forming surfaces and forming a first die-size opening therebetween used for bending and forming a material of a predetermined gauge.

Each one of the anvils is selectively rotatable to second through fourth positions so that second through fourth ones of the four corners having the same radius of curvatures are on top and facing inwardly toward the other corresponding to second through fourth ones of the four alternative forming surfaces and forming second through fourth die-size openings therebetween used for bending and forming a material of different predetermined gauges.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 2:
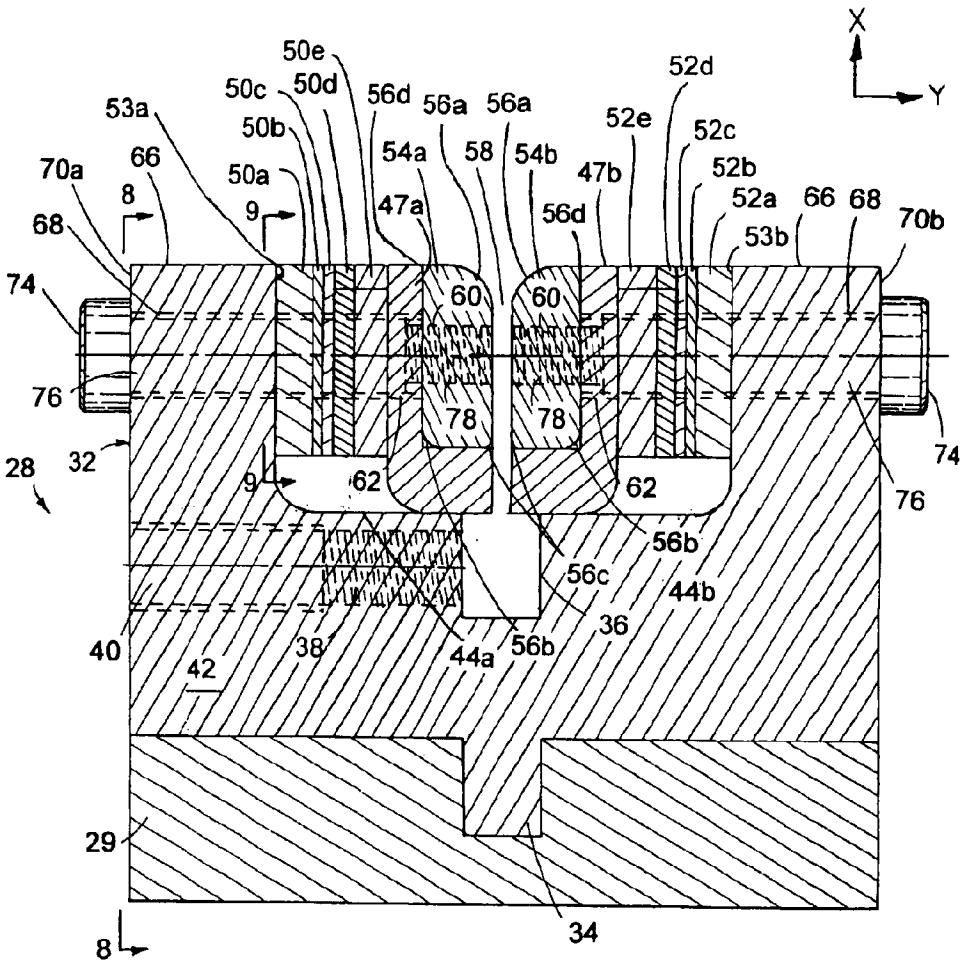
FIG. 2 is a cross-sectional view of a lower die base, constructed in accordance with the principles of the present invention and illustrating the various components in their assembled condition.

It is to be distinctly understood at the outset that the present invention shown in the drawings and described in detail in conjunction with the preferred embodiments is not intended to serve as a limitation upon the scope or teachings thereof, but is to be considered merely as an exemplification of the principles of the present invention.

Figure 1:
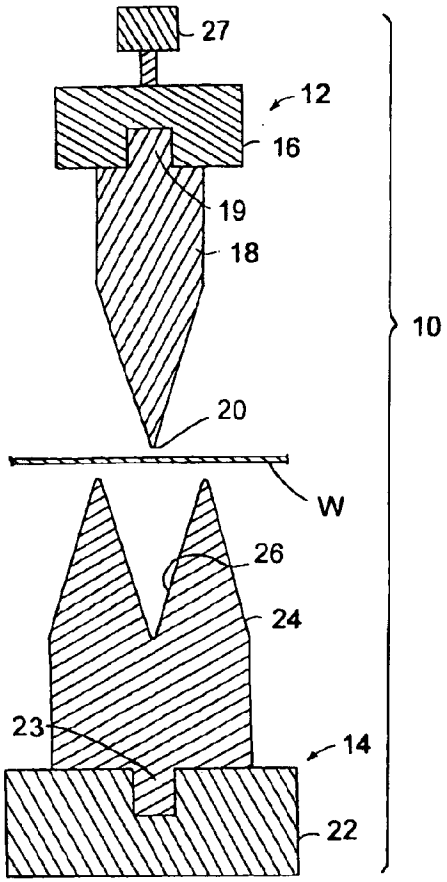
FIG. 1 (PRIOR ART)
FIG. 1 is a simplified, schematic side view of a prior art press brake consisting of an upper press member and a lower press member.

Referring now in detail to the drawings, there is illustrated in FIG. 1 schematic side view of a prior art press brake 10 consisting of an upper press member 12 and a lower press member 14. The upper press member 12 includes an upper table 16 which has affixed thereto a male forming tool 18 (upper die or punch) having a bottom workpiece-deforming surface 20. The upper table has a slot into which is received a tang 19 of the male forming tool 18. The lower press member 14 includes a lower table or press bed 22 which has affixed thereto as appropriately shaped lower die 24 having a V-shaped notch 26 vertically aligned with the workpiece-deforming surface 20 of the upper die .18. The lower table 22 has a slot into which is received a tang 23 of the lower die 24. The upper table 16 is further suitable connected to an actuator or ram 27 that is operable to extend the upper press member 12 toward the lower press member 14 for performing a forming operation on a workpiece W held therebetween and to retract the upper press member away from the lower press member when the forming operation has been completed.

Due to the particular size and shape of the V-shaped notch 26, this conventional lower die 24 can be only used for a single forming operation on a material of a predetermined gauge to be formed into a desired shape. Thus, as previously pointed out, the lower die 24 must removed and replaced with a separate different, appropriately-sized lower die in order to effect different bending operations which is a laborious and time-consuming task. Therefore, a main purpose of the present invention is to replace the conventional lower die having a single-forming capability of the prior art with a new and improved apparatus adapted for use in press brakes for bending and forming sheet material which allows the performance of many different bending operations without the need for changing to a completely different lower die. The instant invention provides for the capability of forming various shapes and bends in different gauges of materials with minimal disruption on the forming operation.

Figure 8:
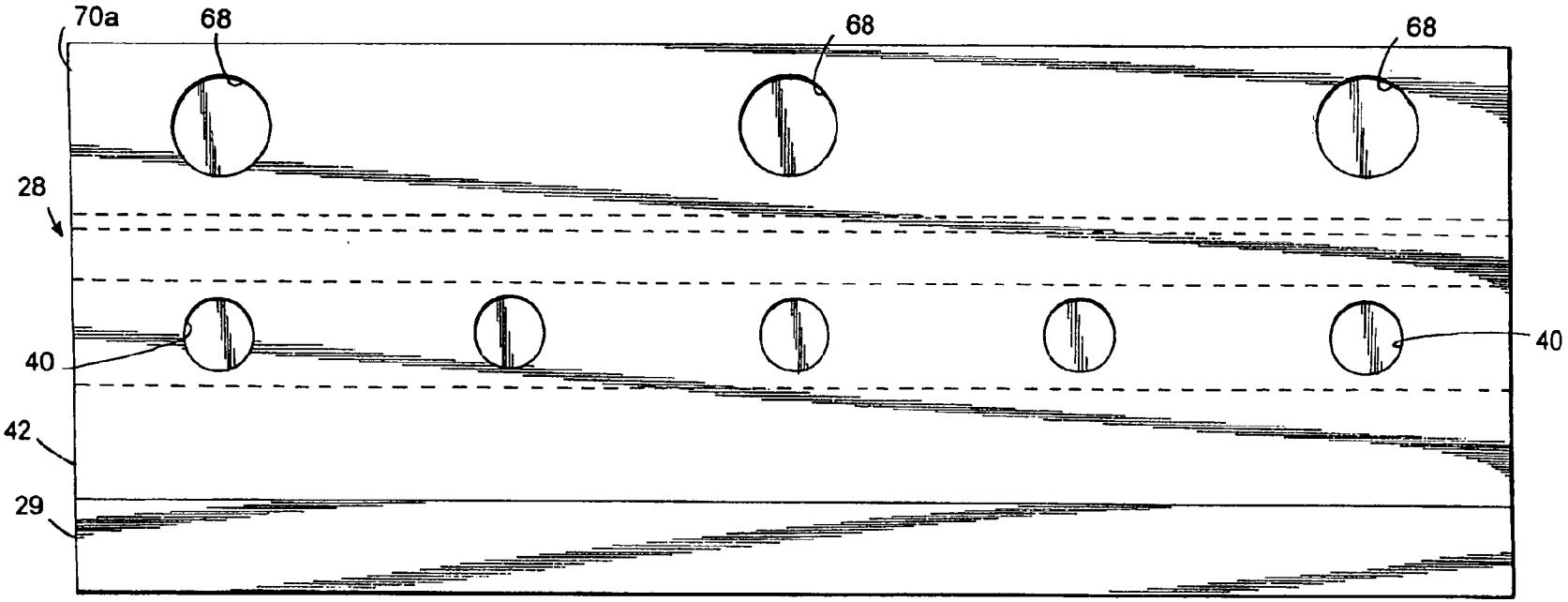
FIG. 8 is a side view of the lower die base of the present invention, taken along the line 8—8 of FIG. 2.
Figure 10:
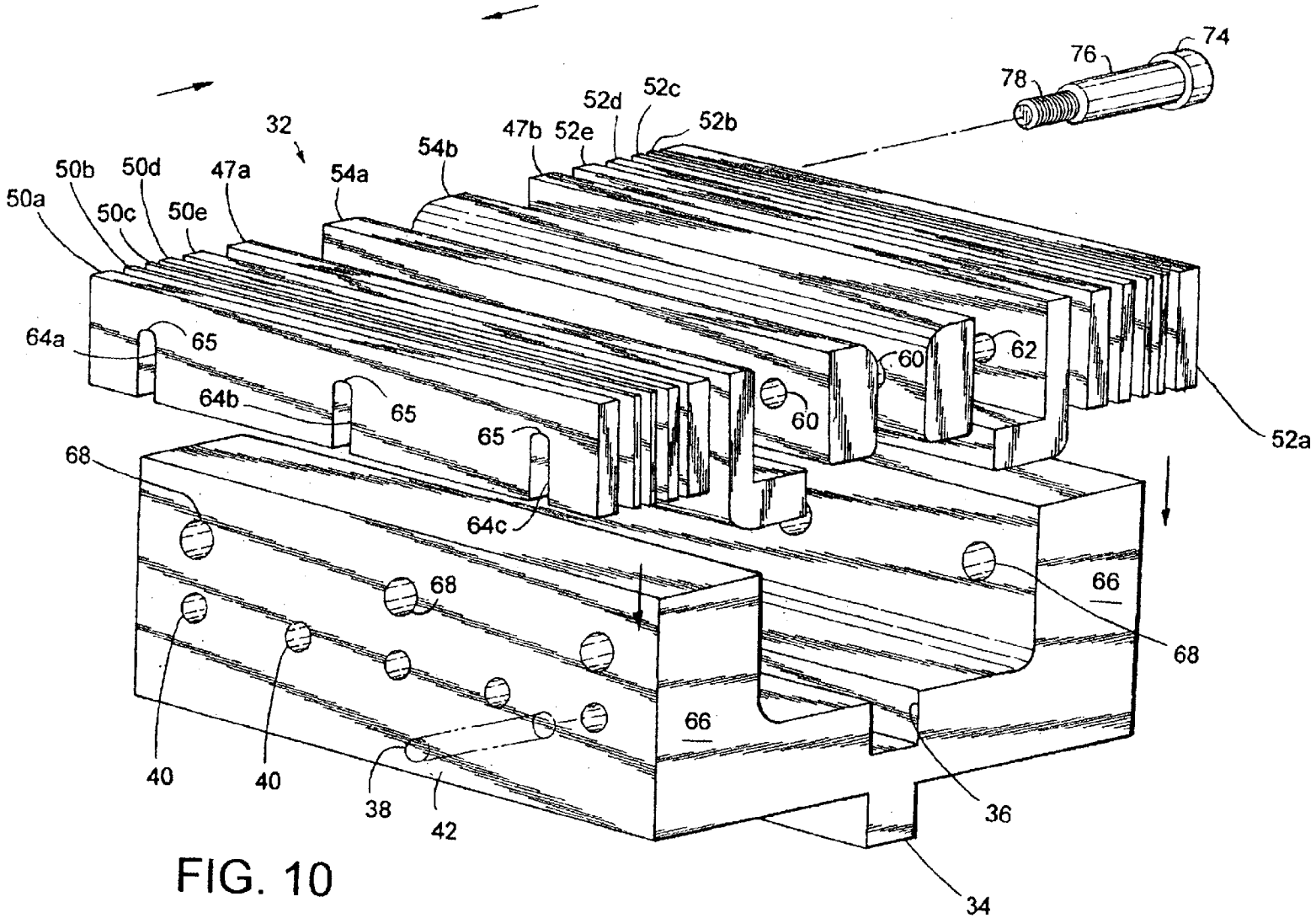
FIG. 10 is an exploded, perspective view of the lower die base of FIG. 3.

With particular reference to FIG. 2, there is shown a cross-sectional view of a lower press member 28, constructed in accordance with the principles of the present invention and illustrating the various components thereof in their assembled condition. FIG. 8 is a side view of the lower press member 28, taken along the lines 8—8 of FIG. 2. FIG. 10 is an exploded, perspective view of the lower press member of FIG. 2.

In order to overcome these problems associated with the conventional lower die 24 in the press brake 10 of FIG. 1, the inventor of the present invention has developed an improved apparatus for bending and forming sheet material which includes the lower press member 28 comprised of a lower brake press bed 29 and a die base assembly 32. The lower brake press bed 29 has a downwardly-extending slot into which a tang 34 of the die base assembly 32 is received. The die base assembly 32 also has a downwardly-extending slot into which a tang of the prior art press brake die can be received. The die base assembly 32 is fixedly secured to the lower brake press bed 29 in a conventional manner by the use of setscrews (not shown) spaced along its length thereof. When the die base assembly 32 is used to hold a prior art press brake die, threaded screws 38 are provided which are threaded into corresponding bores 40 and extend into the adapter slot 36 so as to abut against one side of the tang of the prior art die for retaining the same.

The die base assembly 32 of the present invention includes a die base 42 of a generally U-shaped configuration having a first recess 44*a* and a second recess 44*b* disposed opposite to the first recess. Each of the first and second recesses has affixed therein a corresponding one of mobile carrier shoes 47*a*, 47*b*. The first recess 44*a* has also affixed therein a plurality of removable spacer bars 50*a* through 50*e* all located between the inside wall 53*a* of the die base 42 and the carrier shoe 47*a*. Similarly, the second recess 44*b* has also affixed therein a plurality of removable spacer bars 52*a* through 52*e* all located between the inside wall 53*b* of the die base 42 and the carrier shoe 47*b*. It will be noted that the spacer bars 50*a*–50*e* and 52*a*–52*e* are made of different thickness. For example, the spacer bars 50*a*, 50*e* and 52*a*, 52*e* each has a thickness of one-fourth (0.250) of an inch; the spacer bars 50*b*, 50*c* and 52*b*, 52*c* each has a thickness of one-sixteenth (0.062) of an inch; and the spacer bars 50*d*, 52*d* each has a thickness of one-eighth (0.125) of an inch.

Each of the mobile carrier shoes 47*a*, 47*b* is of L-shaped configuration and has affixed therein a corresponding one of the pair of rectangularly-shaped, rotatable anvils 54*a*, 54*b*. It can be seen that each of the four corners 56*a* through 56*d* on each anvil 54*a*, 54*b* is provided with a separate and distinct radius of curvature so as to define four alternative forming surfaces. For instance, the corners 56*a* are fabricated with a one-fourth (0.250) inch radius of curvature; the corners 56*b* are provided with a one-eighth (0.125) inch radius of curvature; the corners 56*c* are fabricated with a one-sixteenth (0.062) inch radius of curvature; and the corners 56*d* are provided with a one thirty-secondth (0.031) inch radius of curvature.

As shown in FIG. 2, each of the pair of rotatable anvils 54*a*, 54*b* is positioned so that the corresponding corners 56*a*, are on top and facing inwardly and opposite each other for defining a first position of the four alternative forming surfaces. In this first position, with the same radii of curvature on the top corners and facing inwardly toward each other there is provided a downwardly-extending gap or opening 58 of one-eighth inch between the pair of anvils 54*a*, 54*b* defining one die-size opening for the bending and forming of a material of a predetermined gauge. When the pair of anvils is used in conjunction with an associated male forming tool or punch, such as shown in FIG. 1, a single forming operation is achieved.

Each of the anvils 54*a*, 54*b* is further provided with central internally threaded bores 60 extending horizontally therethrough. Each of the mobile carrier shoes 46*a*, 46*b* is provided with corresponding bores 62 aligned laterally with the respective bores 60. Each of the plurality of spacer bars 50*a*–50*e* and 52*a*–52*e* are provided with inverted U-shaped notches 64*a*–64*c* which are used to facilitate their ready removal and replacement, as will be explained hereinbelow. Each integral arm 66 of the die base 42 is provided with bores 68 disposed concentrically and aligned laterally with the notches 64*a*–64*c* and the bores 62,60. The bores 68 extends from outside wall 70*a*, 70*b* of the die base 42 through to its inside walls 53*a*, 53*b*.

The spacer bars, mobile carrier shoes, and rotatable anvils are held against the respective inside walls 53*a*, 53*b* of the die base 42 by a plurality of opposed bolts 74. Each of the plurality of bolts has a shaft 76 and a small threaded portion 78. The bolts extend through the respective bores 68 in the die base, through the notches 64*a*–64*c* in the spacer bars, and through the bores 62 in the mobile carrier shoes, and are threaded into the threaded bores 60 on the pair of anvils via the threaded portions 78.

Figure 3:
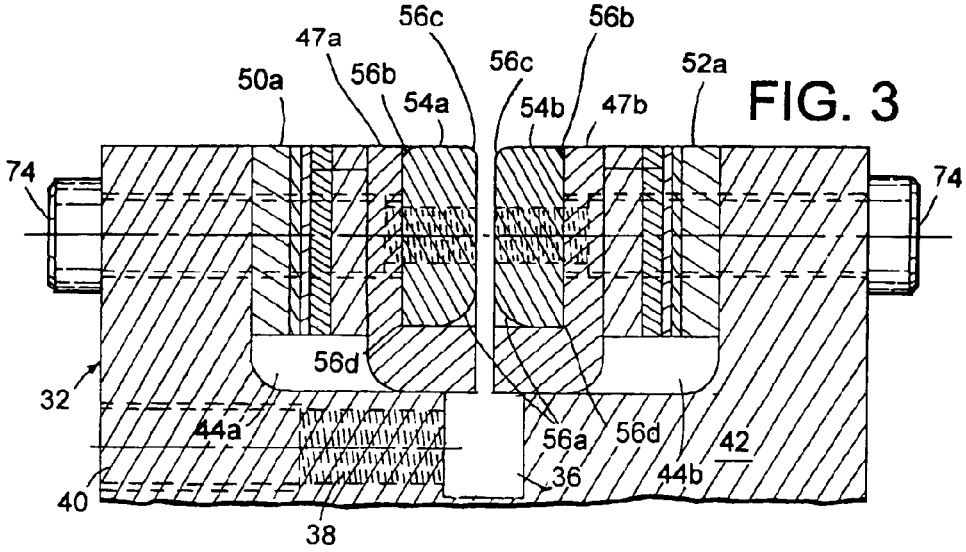
FIG. 3 is a cross-sectional view of the die base assembly of FIG. 2, but with the anvils rotated to a second position of the alternative forming surfaces.

In order to change the pair of rotatable anvils 54*a*, 54*b* of FIG. 2 from the first position of the four alternative forming surfaces, the bolts 74 are initially loosened from the anvils and the pair of anvils are then rotated or inverted 180 degrees about the horizontal or x-axis so that the corners 56*c* are now on top and facing inwardly toward each other for defining a second position of the four alternative forming faces. This second position creates another die-size opening for bending and forming a material having another predetermined gauge of thickness. This second position is illustrated in FIG. 3 of the drawings.

Figure 4:
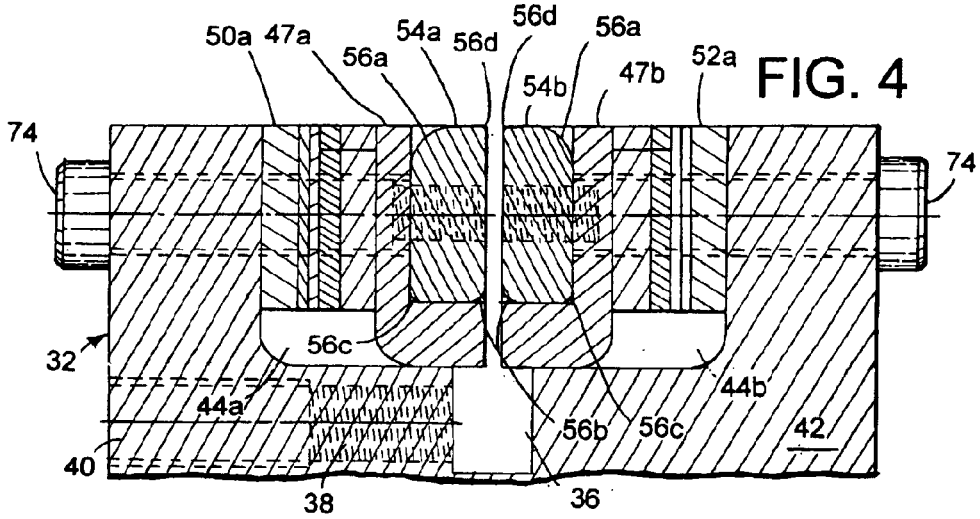
FIG. 4 is a cross-sectional view of the die base assembly of FIG. 2, but with the anvils rotated to a third position of the alternative forming surfaces.

On the other hand, the pair of anvils in FIG. 2 could be rotated 180 degrees about the vertical or y-axis so that the corners 56*d* are now on top and facing inwardly toward each other for defining a third position of the four alternative forming surfaces. This third position creates still another die-size opening for bending and forming a material having another predetermined gauge of thickness. This third position is illustrated in FIG. 4 of the drawings. Thereafter, the anvils can again be rotated 180 degrees about the x-axis so the corners 56*b* are now on top and facing inwardly toward each other for defining a fourth position of the four alternative forming surfaces. This fourth position creates still yet another die-size opening for bending and forming a material having another predetermined gauge of thickness. This fourth position is illustrated in FIG. 5 of the drawings.

As a result, it can be seen that the anvils are selectively rotatable so to provide the first through fourth positions of the four alternative forming surfaces. These anvils have a width dimension of about one-half inch; a height dimension of about one and one-fourth inch; and a length of about twenty-five inches. Since these anvils are substantially smaller and lighter than the conventional lower dies, they can be rotated to the different positions in substantially less time, thereby reducing downtime and labor cost.

Referring again to FIG. 2, the gap 58 between the pair of anvils is approximately one-eighth inch as stated above and defines a first die-size opening for the bending and forming of a material having a specific gauge. In order to accommodate other specific gauges of materials, the spacer bars 50*a*–50*e* and 52*a*–52*e* of varying thickness are appropriately transferred to opposed outside walls 70*a*, 70*b* of the die base 42 in one-eighth inch increments so as to provide twelve additional separate and distinct, expanded die-size openings Therefore, there are provided thirteen positions per the first position of the four alternative forming surfaces.

Figure 5:
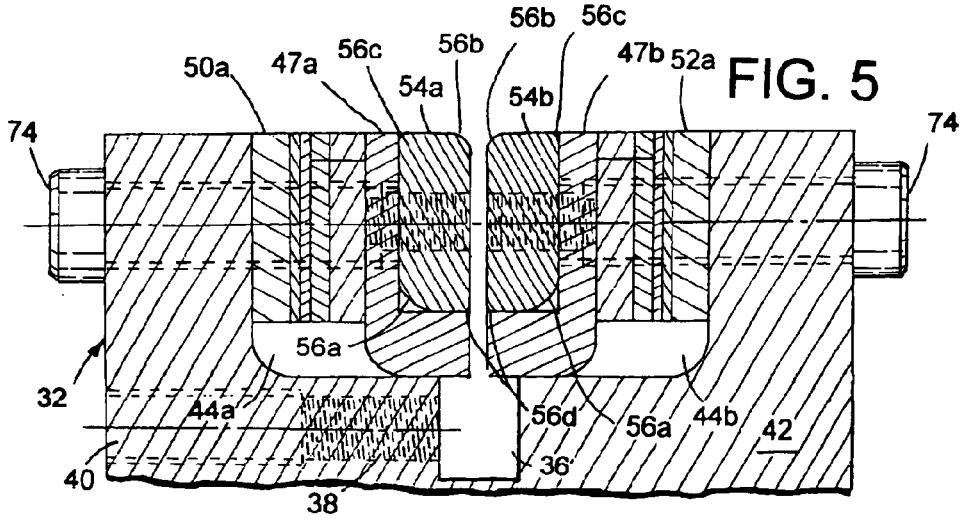
FIG. 5 is a cross-sectional view of the die base assembly of FIG. 2, but with the anvils rotated to a fourth position of the alternative forming surfaces.

Since the size of the gap between the pair of anvils after being rotated to the positions of FIGS. 3 through 5 can likewise be increased in one-eighth inch increments so as to provide twelve additional separate and distinct, expanded die-size openings for each corresponding second through fourth positions of the four alternative forming surfaces, there are provided thirty-nine more die-size openings. As a result, the rotatable anvils and removable spacer bars in the die base of the present invention allow a total of fifty-two separate and distinct, expanded die-size openings for accommodating fifty-two different bending and forming operations.

With reference still to FIG. 2, the operation of moving the spacer bars 50*a*–50*e* and 52*a*–52*e* to provide the twelve additional die-size openings will now be explained. In order to obtain the second die-size opening, the bolts 74 on each side of the die base 42 are loosened so to cause the spacer bars to loosen to the point of being removable. Then, one of the spacer bars having the thickness of one-sixteenth of an inch, i.e., 50*b* and 52*b*, on each side of the carrier shoes are lifted up and removed therefrom. With the bolts being drawn outwardly to allow removal of the spacer bars, this creates a pocket between the heads of the bolts and the outside walls 70*a*, 70*b* of the die base 42 in which is received the just removed spacer bar with its notches 64*a*–64*c* resting on top of the shaft 76 of the bolts. Next, the bolts are re-tightened with the removed spacer bar being installed adjacent to the outside walls for the die base. This causes the head of the bolts to press the spacer bars against the outside walls to draw the anvils outward, thereby increasing the one-eighth inch gap between the pair of anvils by one-eighth inch to create the second expanded die-size opening. This is illustrated in FIG. 6 of the drawings.

Figure 7:
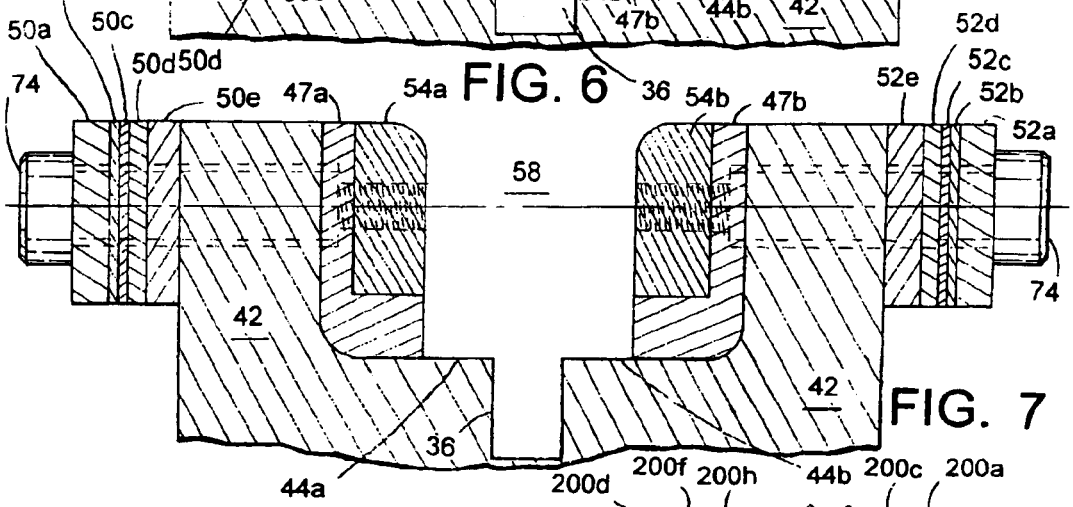
FIG. 7 is a cross-sectional view of the die base assembly of FIG. 2, but with all of the removable spacer bars on each side being moved to the outside walls of the die base.

This process is repeated continuously over and over in one-eighth increments until all of the spacer bars 50*a*–50*e* and 52*a*–52*e* have been transferred to be adjacent the outside walls of the die base. This is depicted in FIG. 7 of the drawings. Consequently, this process has provided the twelve additional expanded die-size openings for the first position of the four alternative forming surfaces due to the outward movement of the opposed anvils. It should be apparent to those skilled in the art that this process may now be reversed by moving the spacer bars in one-eighth inch increments back to their original positions for contracting the die-size openings until the first position shown in FIG. 2 is reached again. Moreover, this process can be likewise performed on the spacer bars in the second through fourth positions of the forming surfaces in FIGS. 3–5, thereby realizing the total fifty-two different forming operations.

Figure 9:
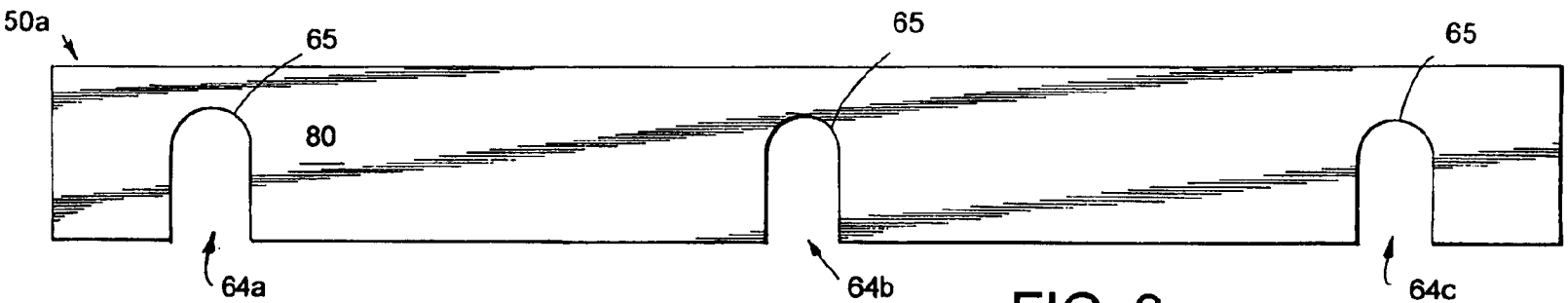
FIG. 9 is a side view of one of the plurality of spacer bars of the present invention, taken along the lines 9—9 of FIG. 2.

In FIG. 9, there is illustrated a side view of one of the spacer bars, i.e., 50*a* taken along the line 9—9 of FIG. 2. The spacer bar is generally of an elongated, rectangular shape having a height dimension of slightly less than one and one-fourth inches and length dimension of about twenty-five inches. The plurality of inverted U-shaped notches 64*a*–64*a* formed in the flat surface 80 are contoured and dimensioned so that the arch-shaped portion 65 are adapted to fit over and rest on top of the shaft portion 76 of the bolts. These notches facilitate the easy and quick removal and replacement of the spacer bars by simply lifting-up for removal and dropping-in place for replacement. While the spacer bars are depicted as being substantially flush with the top surfaces of the die base, carrier shoes, and anvils, they are preferable designed to be slightly shorter in height so as to avoid any potential interference with the material to be formed as it is slid across the top surfaces of the die base, carrier shoes, and anvils.

Figure 6:
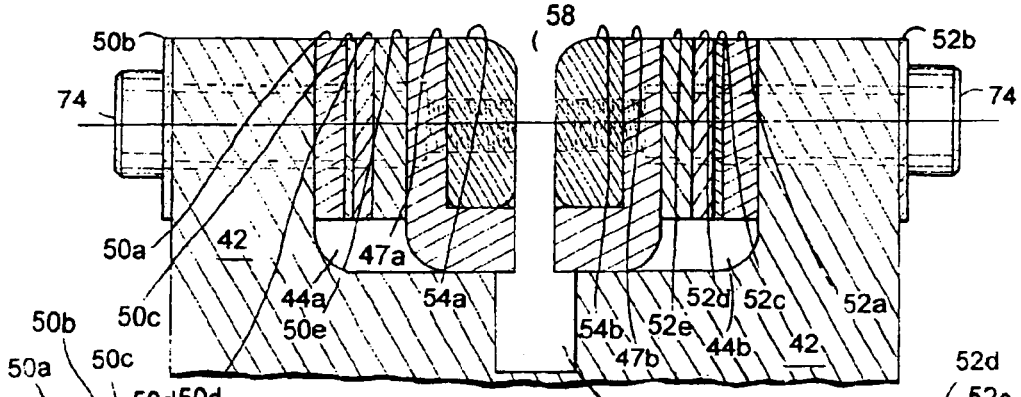
FIG. 6 is a cross-sectional view of the die base assembly of FIG. 2, but with one of the removable spacer bars on each side being moved to the outside walls of the die base.

Although it is anticipated that many alternate uses of the present invention shown in FIGS. 2–10 will be employed, it is envisioned that the preferred embodiment herein just described has particular application for use in press brakes for bending and forming of sheet material, such as sheet metal, plate sheet and the like having a thickness of up to 0.187 inch. When all of the spacer bars are transferred to be adjacent to the outside walls of the die base as shown in FIG. 6 and the pair of anvils are rotated to the position shown in FIG. 4 where the corners 56*d* are on top and facing inwardly toward each other the maximum die-size opening for creating 90 degree bends is equal to 1.625 inches as measured between the inside edges of the anvils (edge-to-edge). When all of the spacer bars are transferred to be adjacent to the outside walls of the die base as shown on FIG. 6 and the pair of anvils are rotated to the position shown in FIG. 2 where the corners 56*a* (0.250 radii of curvature) are on top and facing inwardly toward each other the maximum die-size opening for creating acute bends (i.e., 30 degrees to 88 degrees) is equal to 2.125 inches as measured between the centers of the radii of curvature (center-to-center). It should be understood by those skilled in the art that an associated upper table have a punch ranging from, but not limited to, "28 degrees" punch to "85 degrees" punch would be used with the associated anvils to perform the different forming operations.

Figure 11:
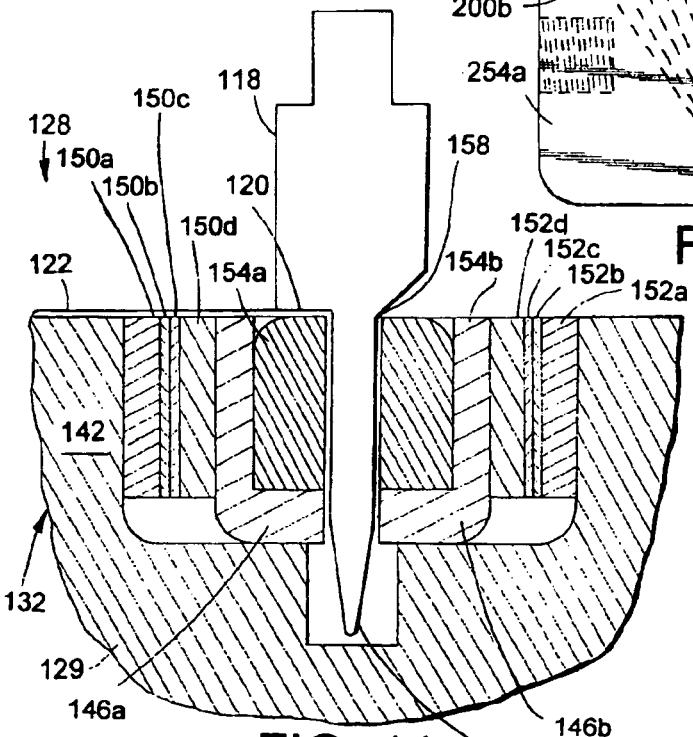
FIG. 11 is a side view of die base assembly of the present invention for use as a three-high die for performing a hemming operation on a sheet material.

In FIG. 11, there is a side view of the die base assembly of the present invention for use with a punch in a C-N-C press brake type of design commonly referred as a "three-high die". The lower press member 128 is comprised of a lower press brake bed 129 and a die base assembly 132. The die base assembly 132 includes a die base 142 for housing mobile carrier shoes 146*a*, 146*b*; a plurality of spacer bars 150*a*–150*d* and 152*a*–152*d*; and a pair of anvils 154*a*, 154*b*. This is quite similar to the various components shown in FIG. 4, except that one of the spacer bars on each side of the carrier shoes has been removed. The spacer bar (not shown) of one-eighth inch thickness has been moved to be adjacent to the outside walls (also not shown) of the die base. Thus, the gap 158 of 0.375 inch wide is provided between the anvils 154*a*, 154*b* which is sufficiently large enough for receiving therein a male forming tool or punch 118. It will be noted that a deep pocket 160 is provided which extends below the gap 158 to accommodate a longer first stroke of the punch. This deep pocket 160 is also used to hold the tang of the prior art press brake die.

The C-N-C press brake type of design provides a stroking capability of performing in sequence a short stroke first which performs an acute bend and a second longer stroke which squeezes the material being formed together or "closes hem". In operation, the first stroke is delivered to the material held over the anvils 154*a*, 154*b* by the acute punch 118 with a ledge portion 120 machined formed therein. The acute punch will penetrate the gap 158 to the point of the acute bend in the material held per the angle formed in the acute punch. The bent material is then removed and repositioned in the die base so that the second stroke will close the acute bend in the material onto itself, as illustrated in FIG. 11, by using the ledge portion 120 of the acute punch 118. It will be noted that the ledge portion traps the acute bend in the material 122 between the bottom surface of the ledge portion and the top surface of the anvil 154*a* as the punch descends to the correct closing depth. The long stroke of the acute punch is designed into the C-N-C press brake.

Figure 12:
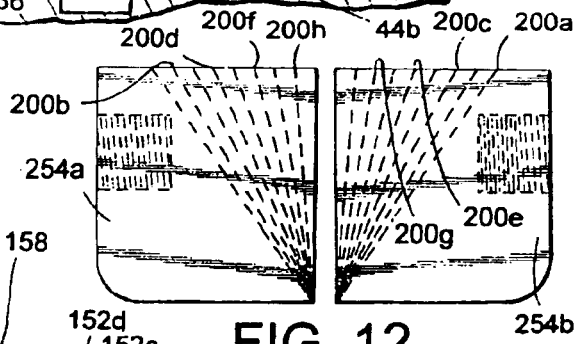
FIG. 12 is a side view of an alternate embodiment of the present invention, illustrating enlarged anvils.

In FIG. 12, there is depicted a second embodiment of the present invention where the small anvils and carrier shoes in FIGS. 2–10 are replaced with a pair of enlarged anvils 254*a*, 254*b*. The small anvils 54*a*, 54*b* of FIGS. 2–10 have a width dimension of about 0.500 inch and a height dimension of about 1.188 inch. On the other hand, the enlarged anvils have a minimum width dimension of about 0.750 inch which is equal to the combined widths of the small anvil 54*a* (54*b*) and the carrier shoe 46*a* (46*b*). The height dimension of the enlarged anvils is equal to 1.625 inches which is the height of the carrier shoes 46*a*, 46*b*. The enlarged anvils serve to increase the bending capability by accommodating the bending of materials having various gauges with different angles or special complex shapes/designs during the bending operations as specified by a user.

The forming surfaces of the enlarged anvils can be provided with one of a number of shapes or forms, such as indicated by the dotted lines 200*a*–200*h*, which otherwise may be impractical or impossible to machine. The increased width of the enlarged anvils permits increased machining capability since the carrier shoes 46*a*, 46*b* have been eliminated, thereby reducing limitations of machining a specific shape or form thereon. Further, the width size of the enlarged anvils may be increased or changed to have other dimensions as desired by the user.

From the foregoing detailed description, it can thus be seen that the present invention provides an improved apparatus used in press brakes having a lower press member and an upper press member which are movable relative toward and away from each other for bending and forming sheet materials. The apparatus includes a die base, first and second mobile carrier shoes, a plurality of spacer bars, and a pair of anvils. Each one of the pair of anvils is formed with four corners each having a separate and distinct radius of curvature so as to define four alternative forming surfaces. Each one of the anvils are selectively rotatable so that one of the four corners having the same radius of curvatures are on top and facing inwardly toward the other corresponding to first through fourth ones of the four alternative forming surfaces and forming first through fourth die-size openings therebetween used for bending and forming a material of different predetermined gauges. As a result, multiple bending operations with different gauges of sheet material can be achieved without changing completely to a different lower die.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An apparatus used in press brakes having a lower press member and an upper press member which are movable relative toward and away from each other for forming bending and forming sheet materials, said lower press member comprising:

a die base formed of a generally U-shaped configuration and having a first recess and a second recess disposed opposite to said first recess;

first and second mobile carrier shoes being disposed in a corresponding one of said opposed first and second recesses;

a plurality of first and second movable spacer bars being also disposed in a corresponding one of said opposed first and second recesses;

a pair of anvils each one being disposed in a corresponding one of said first and second mobile carrier shoes;

each one of said pair of anvils being formed of a rectangular shape and having four corners each provided with a separate and distinct radius of curvature so as to define four alternative forming surfaces;

each one of said anvils being initially positioned so that a first one of the four corners having the same radius of curvature are on top and facing inwardly toward the other corresponding to a first one of the four alternative forming surfaces and forming a first die-size opening therebetween used for bending and forming a material of a predetermined gauge; and each one of said anvils being selectively rotatable to second through fourth positions so that second through fourth ones of the four corners having the same radius of curvatures are on top and facing inwardly toward the other corresponding to second through fourth ones of the four alternative forming surfaces and forming second through fourth die-size openings therebetween used for bending and forming a material of different predetermined gauges.

2. An apparatus for bending and forming sheet material as claimed in claim 1, wherein the first one of the four corners on each one of said pair of anvils has a radius of curvature equal to 0.031 inch, the second one has a radius of curvature equal to 0.062 inch, the third one has a radius of curvature equal to 0.125 inch, and the fourth one has a radius of curvature equal to 0.250.

3. An apparatus for bending and forming of sheet material as claimed in claim 1, wherein each one of said plurality of first and second movable spacer bars are made of a different thickness.

4. An apparatus for bending and forming of sheet material as claimed in claim 3, wherein each one of said plurality of first and second movable spacer bars consist of five spacer bars, said plurality of first spacer bars being disposed between a first inside wall of said die base and said first carrier shoe, said plurality of second spacer bars being disposed between a second inside wall of said die base and said second carrier shoe.

5. An apparatus for bending and forming of sheet material as claimed in claim 4, wherein a first one of said plurality of first and second spacer bars has a thickness of 0.250 inch, a second one of said plurality of first and second spacer bars has a thickness of 0.062 inch, a third one of said plurality of first and second spacer bars has a thickness of 0.062 inch, a fourth one of said plurality of first and second spacer bars has a thickness of 0.125 inch, and a fifth one of said plurality of first and second spacer bars has a thickness of 0.250 inch.

6. An apparatus for bending and forming of sheet material as claimed in claim 5, wherein the second one of said plurality of first and second spacer bars are transferred to be adjacent to outside walls of said die base so as to increase the first through fourth die-size openings by 0.125 inch.

7. An apparatus for bending and forming of sheet material as claimed in claim 4, wherein the first through fifth ones of said plurality of first and second spacer bars are transferred sequentially in 0.062 inch increments to be adjacent to outside walls of said die base, thereby allowing twelve additional expanded die-size openings for each of the first through fourth die-size openings per each corner of said anvils.

8. An apparatus for bending and forming of sheet material as claimed in claim 3, each one of said plurality of first and second spacer bars are transferred sequentially to be adjacent to outside walls of said die base, thereby allowing additional expanded die-size openings for each of the first through fourth die-size openings per each corner of said anvils.

9. An apparatus for bending and forming of sheet material as claimed in claim 4, wherein said five spacer bars of said plurality of first and second spacer bars are formed with a plurality of inverted U-shaped notches so as to facilitate the easy removal from the first and second inside walls and their replacement on outside walls of said die base.

10. In a press brake for bending and forming sheet materials, the improvements comprising:

die base means having a first recess and a second recess disposed opposite to said first recess;

first and second enlarged anvils being disposed in a corresponding one of said opposed first and second recesses;

spacer bar means being also disposed in a corresponding one of said opposed first and second recesses;

said spacer bar means including a plurality of first and second movable spacer bars which are made of a different thickness;

each one of said first and second enlarged anvils having a forming surface facing inwardly toward the other surface so as to form a die-size opening therebetween used for the forming and bending of a material of a predetermined gauge; and each one of said forming surfaces having one of a number of special shapes used in performance of a forming operation.

11. In a press brake as claimed in claim 10, wherein each one of said plurality of first and second movable spacer bars consists of five spacer bars, said plurality of first spacer bars being disposed between a first inside wall of said die base means and said first enlarged anvil, said plurality of second spacer bars being disposed between a second inside wall of said die base means and said second enlarged anvil.

12. In a press brake as claimed in claim 11, wherein a first one of said plurality of first and second spacer bars has a thickness of 0.250 inch, a second one of said plurality of first and second spacer bars has a thickness of 0.062 inch, a third one of said plurality of first and second spacer bars has a thickness of 0.062 inch, a fourth one of said plurality of first and second spacer bars has a thickness of 0.125 inch, and a fifth one of said plurality of first and second spacer bars has a thickness of 0.250 inch.

13. In a press brake as claimed in claim 12, wherein the second one of said plurality of first and second spacer bars are transferred to be adjacent to outside walls of said die base means so as to increase the die-size opening by 0.125 inch.

14. In a press brake as claimed in claim 12, wherein the first through fifth ones of said plurality of first and second spacer bars are transferred sequentially in 0.062 inch increments to be adjacent to outside walls of said die base means, thereby allowing twelve additional expanded die-size openings for the die-size opening between said enlarged anvils.

15. In a press brake as claimed in claim 10, each one of said plurality of first and second spacer bars are transferred sequentially to be adjacent to outside walls of said die base means, thereby allowing additional expanded die-size openings for the die-size opening between said enlarged anvils.

16. In a press brake as claimed in claim 11, wherein said five spacer bars of said plurality of first and second spacer bars are formed with a plurality of inverted U-shaped notches so as to facilitate the easy removal from the first and second inside walls and their replacement on outside walls of said die base means.

17. A method for use in press brakes having a lower press member and an upper press member which are movable toward and away from each other for bending and forming sheet materials, said method comprising:

providing a die base having a first recess and a second recess disposed opposite to the first recess;

affixing first and second carrier shoes in a corresponding one of said opposed first and second recesses;

affixing also a plurality of first and second movable spacer bars in a corresponding one of said opposed first and second recesses;

affixing a pair of anvils in a corresponding one of said carrier shoes;

forming the four corners on each one of said pair of anvils with a separate and distinct radius of curvature so as to define four alternative forming surfaces;

positioning initially each one of said pair of anvils so that a first one of the four corners having the same radii of curvature are on top and facing inwardly toward the other corresponding to a first one of the four alternative forming surfaces to provide a first die-size opening therebetween used for the bending and forming of a material of a predetermined gauge; and selectively rotating each one of said pair of anvils to second through fourth positions so that second through fourth ones of the four corners having the same radii of curvatures are on top and facing inwardly toward the other corresponding to second through fourth ones of the four alternative forming surfaces to provide second through fourth die-size openings therebetween used for the bending and forming of a material of different predetermined gauges.

18. A method as claimed in claim 17, further including the step of transferring sequentially each one of said plurality of first and second spacer bars to be adjacent to outside thereby allowing additional expanded die-size opening for each of the first through fourth die-size opening per each corner of said anvils.

* * * * *